United States Patent [19]

Patel et al.

[11] Patent Number: 4,767,351

[45] Date of Patent: Aug. 30, 1988

[54] HIGH VOLTAGE EXTERNALLY-SEPARABLE BUSHING

[75] Inventors: Janak R. Patel, Indianhead Park; Robert J. Wilk, Oak Forest, both of Ill.

[73] Assignee: G & W Electric Company, Blue Island, Ill.

[21] Appl. No.: 896,529

[22] Filed: Aug. 13, 1986

[51] Int. Cl.[4] ..... H01R 13/627

[52] U.S. Cl. ..... 439/363; 439/364; 439/556; 439/564

[58] Field of Search ..... 339/94, 60, 119, 120, 339/125, 126, 92, 130, 177, 179, 132, 127 C, 129, 263, 111, 115, 116, 214; 174/DIG. 10

[56] References Cited

U.S. PATENT DOCUMENTS

| | | | |
|---|---|---|---|
| 1,536,024 | 4/1925 | Kvaal | 339/92 R |
| 2,866,171 | 12/1958 | Newcombe | 339/202 |
| 3,153,114 | 10/1964 | Lindway et al. | 174/18 |
| 3,267,205 | 8/1966 | Dozier | 174/153 |
| 3,474,386 | 10/1969 | Link | 339/111 |
| 3,509,516 | 4/1970 | Phillips et al. | 339/94 |
| 3,512,118 | 5/1970 | Leonard | 339/60 |
| 3,622,688 | 11/1971 | Link et al. | 174/142 |
| 3,825,320 | 7/1974 | Redfern | 350/96 B |
| 3,861,776 | 1/1975 | Clark | 339/92 R |
| 3,861,777 | 1/1975 | Clark | 339/92 R |
| 3,883,208 | 5/1975 | Sankey et al. | 339/92 R |
| 4,117,254 | 9/1978 | Richter | 174/15 BH |
| 4,199,213 | 4/1980 | Tachik | 339/111 |
| 4,214,118 | 7/1980 | Gray | 174/15 BH |
| 4,353,611 | 10/1982 | Sibens et al. | 339/92 R |
| 4,508,413 | 4/1985 | Bailey | 339/129 |
| 4,611,093 | 9/1986 | Farmer et al. | 174/152 R |

FOREIGN PATENT DOCUMENTS

| | | | |
|---|---|---|---|
| 5302 | of 1909 | United Kingdom | 339/214 R |

*Primary Examiner*—David Pirlot

*Attorney, Agent, or Firm*—Leydig, Voit & Mayer

[57] ABSTRACT

A bushing, having an elongated conductor substantially encased in insulating material, which extends in sealing relationship through an aperture in a sealed enclosure encasing an electrical apparatus, comprising a conductor having two parts, a first generally cylindrical rod part which is permanently fixed at its proximal end to the electrical apparatus and which extends therefrom toward the aperture, and a second sleeve part having a generally annular passage disposed to circumferentially engage substantially all of the first rod part and thereby provide a conductive path therebetween; a one-piece insulator permanently attached to and substantially encasing the sleeve part of the conductor; means for threadably connecting the two parts of the conductor such that connection and disconnection can be accomplished from outside the enclosure, thereby enabling disconnection of the sleeve part and the insulator from the electrical apparatus without opening the enclosure; and means for sealing the junction of the two parts of the conductor so as to contain the environment within the enclosure.

13 Claims, 1 Drawing Sheet

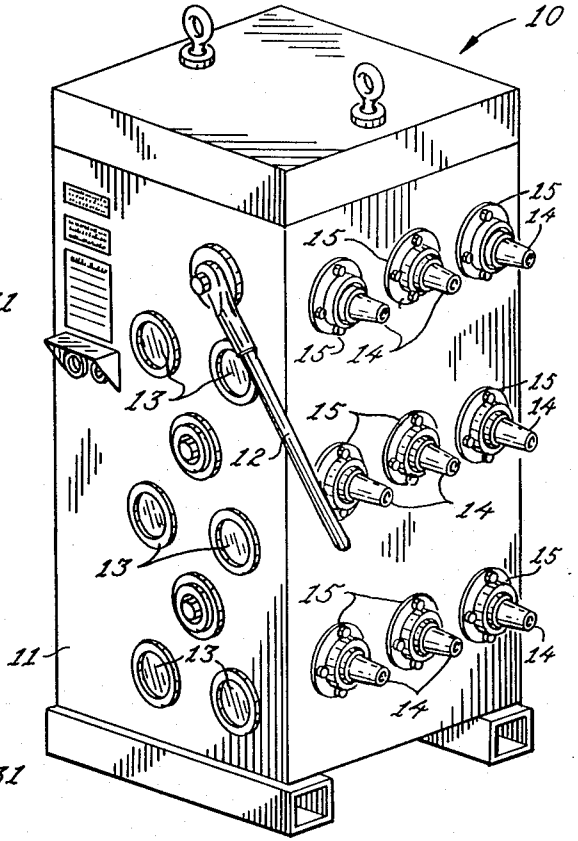
FIG. 1
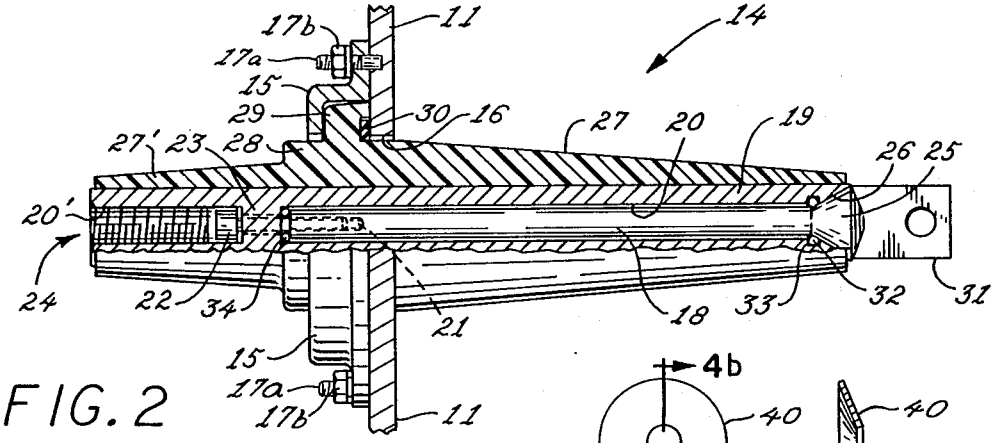
FIG. 2
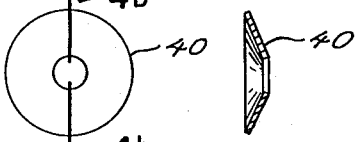
FIG. 4a
FIG. 4b
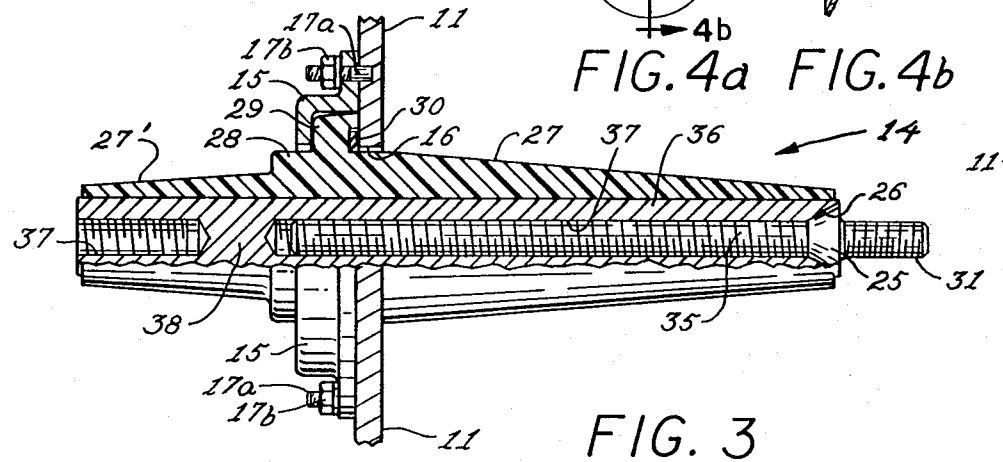
FIG. 3

HIGH VOLTAGE EXTERNALLY-SEPARABLE BUSHING

TECHNICAL FIELD

The present invention relates generally to electrical bushings, and, more particularly, to an externally-separable bushing for use with high voltage equipment.

BACKGROUND ART

High voltage equipment is commonly sealed within a welded enclosure. The seal is required because the enclosure contains either a gaseous (e.g., $SF_6$) or liquid (e.g., oil) dielectric atmosphere within which the equipment operates. To enable connection between the enclosed equipment and external power lines, a bushing is used to provide a conductor through the wall of the enclosure while simultaneously insulating the conductor from the enclosure and maintaining the seal.

Bushings typically consist of a unitary metal conductor encapsulated in epoxy insulation. The inside end of the bushing (i.e., the proximal end of the conductor) is usually connected rigidly (e.g., by a metallic clamp and hardware) to the enclosed high voltage equipment, while the outside end of the bushing is designed to matingly receive a connector device, such as an elbow connector. The outside end of the bushing (i.e., the insulator body and/or the bushing-to-elbow interface) is subject to damage during both transportation and use which quite often renders the bushing unusable. In this event, the bushing must be replaced, which for a unitary bushing requires opening of the sealed enclosure and disconnection of the bushing from the high voltage equipment. Such replacement procedures are costly, time-consuming and often quite difficult to perform, especially when the equipment is located in the close quarters of an underground vault.

SUMMARY OF THE INVENTION

It is a primary object of the present invention to provide an improved high voltage bushing which, if damaged, can be externally separated from electrical equipment sealed within an enclosure.

It is another object of this invention to provide such an improved high voltage bushing having two threadably connected conductor parts, the first of which is permanently connected to electrical equipment sealed within an enclosure, and the second of which is externally detachable from the first part.

A further object of the present invention is to provide a high voltage bushing which may be quickly, and therefore inexpensively, separated from electrical equipment sealed within an enclosure.

Other objects and advantages of the invention will be apparent from the following detailed description.

In accordance with the present invention, there is provided a bushing, having an elongated conductor substantially encased in insulating material, which extends in sealing relationship through an aperture in a sealed enclosure encasing an electrical apparatus, comprising a conductor having two parts, a first generally cylindrical rod part which is permanently fixed at its proximal end to the electrical apparatus and which extends therefrom towards the aperture, and a second sleeve part having a generally annular passage disposed to circumferentially engage substantially all of the first rod part and thereby provide a conductive path therebetween; a one-piece insulator sealingly attached to and substantially encasing the sleeve part of the conductor; means for threadably connecting the two parts of the conductor such that connection and disconnection can be accomplished from outside the enclosure, thereby enabling disconnection of the sleeve part and the insulator from the electrical apparatus without opening the enclosure; and means for sealing the junction of the two parts of the conductor so as to contain the environment within the enclosure.

BRIEF DESCRIPTION OF THE DRAWINGS

FIG. 1 is a perspective view showing a vault-style switch equipped with the high voltage externally separable bushing of the present invention.

FIG. 2 is a sectional side plan view of a first embodiment of the inventive bushing.

FIG. 3 is a sectional side plan view of a second embodiment of the inventive bushing.

FIGS. 4*a* and 4*b* are a perspective view and a sectional side view, respectively, of a disc spring.

DESCRIPTION OF THE PREFERRED EMBODIMENTS

While the invention will be described in connection with certain preferred embodiments, it will be understood that it is not intended to limit the invention to these particular embodiments. On the contrary, it is intended to cover all alternatives, modifications, and equivalents included within the spirit and scope of the invention as defined by the appended claims.

Turning now to the drawings and referring first to FIG. 1, there is shown a high voltage, vault-style switch 10 designed for load interrupting switching, sectionalizing, testing or grounding of underground cable systems through 38 kV. In a vault-style switch, the high voltage electric equipment is encased within a welded steel tank 11, which is hermetically sealed and fully submersible. A handle 12 is used for operating the enclosed switching equipment, and the operation of the switching equipment can be viewed through windows 13 in the side wall of the steel tank 11. Typically, the sealed steel tank 11 contains either a gaseous (e.g., $SF_6$) or liquid (e.g., oil) dielectric atmosphere within which the high voltage switching equipment operates. Bushings 14, held by brackets 15 in apertures through the side wall of the steel tank 11, are used to provide a conductive path through the wall of the enclosure, thereby enabling connection between the enclosed switching equipment and external power distribution lines, while simultaneously insulating the conductive path from the enclosure and maintaining the enclosure's seal. These bushings typically have an operating range rating of 7½ to 38 kV.

Considering now FIGS. 2 and 3, there is shown a bushing 14 embodying the present invention which is positioned in an aperture 16 in the side wall of the steel tank 11, and is maintained therein by means of a bracket 15, weld-in studs 17*a*, and nuts 17*b*.

In accordance with an important aspect of the present invention, the bushing 14 comprises a conductor having two parts, a first generally cylindrical rod part which is permanently fixed at its proximal end to the electrical apparatus and which extends therefrom towards the aperture 16, and a second sleeve part having a generally annular passage disposed to circumferentially engage substantially all of the first rod part and thereby provide a conductive path therebetween, a one-piece insulator sealingly attached to and substantially encasing the sleeve part of the conductor, and means for threadably connecting the two parts of the conductor such that connection and disconnection can be accomplished from outside the tank 11, thereby enabling disconnection of the sleeve part and the insulator from the electrical apparatus without opening the tank.

Referring to the embodiment of FIG. 2, it will be seen that the bushing 14 comprises a conductor having a first generally cylindrical rod part 18 and a second sleeve part 19, each of which is made of conductive metal such as copper or aluminum. The sleeve part 19 of the conductor has a generally annular passage 20 disposed to slidably engage substantially all of the rod part 18, and thereby provide a conductive path therebetween.

The distal end of the rod part of the conductor has an axial threaded bore 21 for receiving the threaded end of a screw 22, such as a cap screw. The head of the screw 22 is seated on a circumferential shoulder 23 located within the passage 20 of the sleeve part 19 of the conductor, and thus the screw 22 serves to threadably connect the rod 18 and sleeve 19 parts of the conductor. The head of the screw 22 can be accessed through the exterior opening 24 of the sleeve part of the conductor by means of a screwdriver, Allen wrench, or other such tool, thereby enabling turning of the screw, and consequently, external connection/disconnection of the two parts of the conductor. The portion 20' of the annular passage 20 between the exterior opening 24 and the circumferential shoulder 23 is threaded so that a threaded interfacing rod (not shown) made of conductive material can be threadably connected therein. This interfacing rod allows electrical connection between the sleeve part 19 of the conductor and an external connector device (not shown), such as an elbow connector.

In order to enhance the electrical interface and improve the seal between the rod part 18 and the sleeve part 19 of the conductor, the conductor can be designed to comprise an enlarged generally frusto-conical surface 25 on the rod part 18, disposed with its base towards the proximal end 31 of the rod part, and an enlarged generally frusto-conical complementary bore 26 in the passage 20 of the sleeve part 19. Thus, when the rod and sleeve parts of the conductor are threadably connected by means of the screw 22, the frusto-conical surface 25 of the rod part and the frusto-conical bore 26 of the sleeve part matingly engage one another, and thereby improve the conductive path between the two conductor parts.

A one-piece insulator body 27, comprised of high grade epoxy insulaton material, is permanently attached (i.e., sealed) to, and substantially encases, the outer surface of the sleeve part 19 of the conductor, thereby isolating the conductor from the walls of the steel enclosure 11. The portion 27' of the insulator body 27, which, in use, extends exterior to the steel enclosure 11 has a generally frusto-conical shape, and thus, can be readily connected to various well-known connection devices, such as elbow connectors. Moreover, the exterior portion 27' of the insulator body 27 has a pair of integral annular collars 28, 29 which are engaged by the bracket 15 to maintain the bushing in the aperture 16 in the wall of the metal enclosure 11. If desired, a gasket 3 can be located between the collar 29 and the wall of the metal enclosure 11 to seal the junction therebetween.

In use, the proximal end 31 of the rod part 18 of the conductor, which may, among other configurations, be flattened (as shown in FIG. 2) or threaded (as shown in FIG. 3), is permanently attached to the electrical equipment (not shown) encased within the steel enclosure 11. The distal end of the rod part 18 of the conductor extends toward the aperture 16 in the wall of the enclosure 11, and the sleeve part 19 of the conductor slidably engages substantially all of the rod part, thereby providing a conductive path therebetween. To seal the junction between the two parts 18, 19 of the conductor, and thereby maintain the gaseous or liquid environment within the enclosure 11, a resilient O-ring 32 is disposed in a circumferential channel 33 located along the passage 20 of the sleeve part 19 of the conductor. As shown in FIG. 2, this circumferential channel 33 can be located in the enlarged bore 26 in the passage 20. To further enhance the seal between the two parts of the conductor, a resilient O-ring 34 may be disposed within the passage 20 between, and contiguous with, the circumferential shoulder 23 and the distal end of the rod part 18 of the conductor.

It should be noted that in situations where the enhanced sealing provided by the second O-ring 34 is not necessary, conductive spring means (such as one or more of the disc springs 40 shown in FIGS. 4*a* and 4*b*) can replace the O-ring 34 and thereby serve to enhance the conductive path between the two parts of the conductor. Disc springs made of copper-beryllium are particularly suitable for this purpose.

The portions of the bushing 14 which, in use, lie exterior to the steel enclosure 11, are subject to damage which may render the bushing unusable. Specifically, the exterior portion 27' of the insulator body 27 is subject to cracking and/or chipping during transportation and use, and the exterior end of the sleeve part 19 of the conductor, including its threaded annular passage 20', is subject to damage such as cross-threading and melting under short circuit conditions if the associated connector device is not properly secured. The present invention enables disconnection and replacement of the sleeve part 19 of the conductor and the entire insulator body 27, while leaving the rod part 18 of the conductor attached to the electrical equipment encased within the steel enclosure 11. Thus, the steel enclosure 11 need not be cut open, making the bushing replacement procedure quick and inexpensive.

FIG. 3 shows an alternate embodiment of the inventive bushing having an insulator body 27 identical to the insulator body of the embodiment shown in FIG. 2, but which has a modified two-part conductor. Specifically, the conductor of the embodiment shown in FIG. 3 comprises a generally cylindrical conductive rod part 35 and a conductive sleeve part 36 having a generally annular passage 37 disposed to circumferentially engage substantially all of the rod part and thereby provide a conductive path therebetween. The exterior suface of the rod part 35 and the surface of the annular passage 37 of the sleeve part 36 are complementarily threaded so that the two parts of the conductor can be threadably engaged. Thus, the entire insulator body 27, and the sleeve part 36 of conductor permenently affixed thereto, can be externally disconnected from the rod part 35 of the conductor and removed from the aperture 16 in the wall of the steel enclosure 11 by simply removing the bracket 15 and rotating the insulator body 27.

As with the embodiment shown in FIG. 2, the two parts 35, 36 of the conductor shown in FIG. 3 are made of conductive metal, such as copper or aluminum. If enhancement of the conductive interface is desired, the rod part 35 of the conductor can be provided with an enlarged generally frusto-conical surface 25 disposed with its base towards the proximal end 31 of the rod part, and the sleeve part 36 of the conductor can be provided with an enlarged generally frusto-conical complementary bore 26.

In the embodiment of FIG. 3, a wall 38 is located within, and completely blocks, the annular passage 37 of the sleeve part 36 of the conductor, thereby dividing the passage 37 into two separate chambers. This wall 38, which can either be formed integrally with the sleeve part 36 of the conductor (as shown in FIG. 3) or comprise a separate member permenently fixed (e.g., threadably connected and/or welded) within the annular passage 37, completely seals the junction between the two parts of the conductor so that the gaseous or liquid environment within the steel enclosure 11 is effectively contained when the bushing 14 is in place.

Although not shown in the drawings, it will be appreciated that the embodiments shown in FIGS. 2 and 3 may be modified so that the rod part (18 or 35) of the conductor is anchored to the insulator body 27 while the sleeve part (19 or 36) is fixed to the electrical eqiupment sealed within the enclosure 11.

As can be seen from the foregoing detailed description, this invention provides an improved high voltage bushing that can be externally separated from electrical eqiupment sealed within an enclosure. Specifically, the invention provides a bushing having two threadably connected conductor parts which are externally separable, thus enabling fast and inexpensive replacement.

What is claimed is:

1. A bushing, having an elongated conductor substantially encased in insulating material, which extends in sealing relationship through an aperture in a sealed enclosure encasing an electrical apparatus, comprising:

said conductor having two parts, a first generally cylindrical rod part which is fixed at its proximal end to the electrical apparatus and which extends therefrom toward the aperture, and a second sleeve part having a generally annular passage disposed to circumferentially engage the first rod part and thereby provide a conductive path therebetween;

a one-piece insulator sealingly attached to and substantially encasing the sleeve part of the conductor;

means for threadably connecting the two parts of the conductor such that connection and disconnection can be accomplished from outside the enclosure, thereby enabling disconnection of the sleeve part and the one-piece insulator from the electrical apparatus without dismantling the enclosure, said connecting means comprising a screw, a circumferential shoulder within the passage of the sleeve part of the conductor for seating a head of the screw, and a threaded bore in a distal end of the rod part of the conductor for receiving a threaded end of the screw; and means for sealing the junction of the two parts of the conductor so as to maintain the environment within the enclosure.

2. The bushing of claim 1 further comprising conductive spring means disposed within the passage of the sleeve part of the conductor between and contiguous with the circumferential shoulder and a distal end of the rod part of the conductor.

3. The bushing of claim 1 wherein the sealing means comprises at least one resilient O-ring disposed in a circumferential channel located along the passage of the sleeve part of the conductor.

4. The bushing of claim 3 wherein the sealing means further comprises a resilient O-ring diposed within the passage of the sleeve part of the conductor between and contiguous with the circumferential shoulder and a distal end of the rod part of the conductor.

5. The bushing of claim 3 further comprising conductive spring means disposed within the passage of the sleeve part of the conductor between and contiguous with the circumferential shoulder and a distal end of the rod part of the conductor.

6. The bushing of claim 1 wherein the conductor further comprises an enlarged generally frusto-conical surface of the rod part of the conductor, disposed with a portion toward a proximal end of the rod part, and an enlarged generally frusto-conical complementary bore in the sleeve part of the conductor.

7. The bushing of claim 6 further comprising conductive spring means disposed within the passage of the sleeve part of the conductor between and contiguous with the circumferential shoulder and a distal end of the rod part of the conductor.

8. The bushing of claim 6 wherein the sealing means comprises at least one resilient O-ring disposed in a circumferential channel located in an enlarged bore in the sleeve part of the conductor.

9. The bushing of claim 8 wherein the sealing means further comprises a resilient O-ring disposed within the passage of the sleeve part of the conductor between and contiguous with the circumferential shoulder and a distal end of the rod part of the conductor.

10. The bushing of claim 8 further comprising conductive spring means disposed within the passage of the sleeve part of the conductor between and contiguous with the circumferential shoulder and a distal end of the rod part of the conductor.

11. A conducting bushing for providing a high voltage carrying connection from the outside to the inside of a sealed enclosure comprising, in combination:

a one-piece insulator body formed to be fitted through an aperture in an enclosure and to be sealed against an outer wall of the enclosure;

a two-piece conductive connector passing through the insulator body and formed of a sleeve surrounding a rod, one piece of said connector being adapted to be fixed to an electrical device within the enclosure and the other piece of the connector being sealed to said insulator body, said connector pieces having mating surfaces adapted to wedge together to form a good electrical connection when the rod is drawn into the sleeve; and means for releasably drawing the rod into the sleeve operable from an end of the insulator body that is outside the enclosure, whereby the means can be released and the entire insulator body and the connector part sealed thereto can be removed and replaced from outside of the enclosure, said means comprising a screw, a circumferential shoulder within the sleeve for seating a head of the screw, and a threaded bore in a distal end of the rod for receiving a threaded end of the screw.

12. The combination of claim 11 wherein a gas-proof seal is utilized between said insulator body and said outer wall and a gas-proof seal is utilized between said conductive connector and said insulator body and a further gas-proof seal is disposed at said connector mating surfaces.

13. The combination of claim 11 wherein said mating surfaces are male and female frusto-conical surfaces so as to provide substantial electrical conducting surfaces between the pieces of the connector.

* * * * *